United States Patent [19]

Kaesser

[11] Patent Number: 4,512,714

[45] Date of Patent: Apr. 23, 1985

[54] VARIABLE FLOW TURBINE

[75] Inventor: Merle L. Kaesser, Waverly, Iowa

[73] Assignee: Deere & Company, Moline, Ill.

[21] Appl. No.: 529,004

[22] Filed: Sep. 6, 1983

Related U.S. Application Data

[63] Continuation of Ser. No. 349,283, Feb. 16, 1982, abandoned.

[51] Int. Cl.[3] ..... F01D 17/14; F01D 17/18

[52] U.S. Cl. ..... 415/151; 415/205

[58] Field of Search ..... 60/602; 415/126, 127, 415/151, 165, 184–186, 203–205

[56] References Cited

U.S. PATENT DOCUMENTS

| | | | |
|---|---|---|---|
| 2,944,786 | 7/1960 | Angell et al. . | |
| 3,270,495 | 9/1966 | Connor . | |
| 3,292,364 | 12/1966 | Cazier . | |
| 3,313,518 | 4/1967 | Nancarrow . | |
| 3,355,878 | 12/1967 | Birmann . | |
| 3,383,092 | 5/1968 | Cazier . | |
| 3,423,926 | 1/1969 | Nancarrow et al. . | |
| 3,557,549 | 1/1971 | Webster . | |
| 3,639,075 | 2/1972 | Erwin et al. | 415/163 |
| 3,664,761 | 5/1972 | Zastrow | 415/205 |
| 3,775,971 | 12/1973 | Gadefelt . | |
| 3,844,676 | 10/1974 | Betteridge | 415/156 |
| 3,994,620 | 11/1976 | Spraker, Jr. et al. | 415/145 |
| 4,008,572 | 2/1977 | Woollenweber, Jr. | 60/602 |
| 4,084,378 | 4/1978 | Blake | 60/602 |
| 4,169,354 | 10/1979 | Woollenweber | 60/600 |
| 4,177,006 | 12/1979 | Nancarrow | 415/151 |
| 4,220,008 | 9/1980 | Wilber et al. | 60/602 |
| 4,224,794 | 9/1980 | Woollenweber | 60/602 |
| 4,236,492 | 12/1980 | Tholen | 123/119 CD |
| 4,292,807 | 10/1981 | Rannenberg | 60/601 |

FOREIGN PATENT DOCUMENTS

| | | | |
|---|---|---|---|
| 1337864 | 8/1963 | France | 415/204 |
| 44421 | 4/1981 | Japan | 60/602 |

*Primary Examiner*—Robert E. Garrett
*Assistant Examiner*—Joseph M. Pitko

[57] ABSTRACT

An improved variable flow turbine having a turbine housing constructed of a curved section and a volute section. The curved section contains an inlet at one end and is connected to the volute secton at the opposite end. Located within the volute section is a turbine rotor having an outlet which is coaxially aligned with the central axis of the volute section. Positioned at the inlet of the curved section is a control valve for regulating the flow of exhaust gases into the housing. Extending inwardly from the control valve is a divider wall which divides the housing into inner and outer passages. The divider wall is constructed such that the cross-sectional flow area of each the passages within the volute section decreases as they approach the turbine rotor. This unique turbine arrangement enables a turbocharger to operate more efficiently over an engine's operating range.

19 Claims, 7 Drawing Figures

VARIABLE FLOW TURBINE

This application is a continuation of application Ser. No. 349,283, filed Feb. 16, 1982, now abandoned.

FIELD OF THE INVENTION

This invention relates to an improved variable flow turbine and more particularly to an improved variable flow turbine for a turbocharger which can be mounted on an internal combustion engine.

BACKGROUND OF THE INVENTION

Currently, there are two general types of radial inflow turbines which are utilized in turbochargers. One type is known as a fixed geometry turbine which is configured such that the shape and area of the fluid passage(s), which extends from the fluid inlet to the turbine rotor, can not be physically changed. An example of a fixed geometry turbine is described in U.S. Pat. No. 3,664,761, issued to Zastrow in 1972. The second type of turbine is known as a variable flow turbine, one design of which is configured to have radially positioned inner and outer fluid passages with a valve positioned across one of the passages to regulate the fluid flow therethrough. By regulating the size of the opening to the one passage by moving the valve, one can vary the cross-sectional area of the fluid flow path and thereby compensate for variations in the fluid flow rate and pressure caused by operating an engine at different speeds and loads. An example of a variable flow turbine is described in U.S. Pat. No. 4,177,006, issued to Nancarrow in 1979. In the Nancarrow patent, the turbine has a straight fluid inlet portion which leads into a scroll-shaped portion. Both the fluid inlet portion and the scroll-shaped portion are divided into a pair of flow paths. Each of the flow paths are further divided in the scroll-shaped portion only into primary and secondary flow paths by a wall formed integral with the housing. In addition, a valve is disposed at the fluid inlet across the secondary flow path which may be rotated to direct the flow away from the wall to regulate the fluid flow.

Of the two types of turbines, engines using the fixed geometry turbine are less efficient. This is because in turbocharged engines with a fixed geometry turbine, the turbine is matched to the compressor which is normally configured for maximum efficiency when the engine is at its peak torque. Consequently, the engine cannot operate at optimum efficiency at rated speed and load because the efficient operating flow range of the compressor is less than that required by the engine. A variable flow turbine, on the other hand, can increase the engine's rated point efficiency by using compressors with high efficiency at rated speed and load and lower efficiency when the engine is at peak torque. This is possible because the power of the variable flow turbine can be increased at peak torque to compensate for the lower efficiency of the compressor. Also, engines with variable flow turbines are more efficient at less than maximum speeds and loads where maximum charge air pressure is not needed. In these situations, the variable flow turbines can increase the turbine flow area to reduce the exhaust manifold pressure.

Currently, there is a need to develop a turbocharger with a variable flow turbine which is highly efficient throughout the operating range of the engine. Now, an improved variable flow turbine has been invented which can meet these requirements.

SUMMARY OF THE INVENTION

Briefly, this invention relates to an improved variable flow turbine which can be used in a turbocharger to improve the efficiency of an engine. The turbine has a housing constructed of a curved section and a volute section. The curved section contains a fluid inlet at one end and is joined at the opposite end to the volute section. Located within the volute section is a turbine rotor having a fluid outlet which is coaxially aligned with the axis of the volute section. This rotor is rotated by the exhaust gases from the engine's manifold which enter the turbine through the fluid inlet. The turbine also has a control valve positioned at the fluid inlet and a divider wall which extends inwardly from the control valve into both sections of the housing. The divider wall is constructed so as to divide the housing into radially inner and outer fluid passages. In particular, the passages within the volute section are divided so as to have a constantly decreasing cross-sectional area as they approach the turbine rotor. The control valve is employed to regulate flow through the inner passage and by regulating its position the momentum of the exhaust gases can be varied. The curved section extends downstream of the control valve to minimize throttling losses. In addition, by rotating the control valve toward the divider wall to partially or fully block the inner fluid passage, the velocity of the exhaust gases increase as they are routed onto the blades of the turbine rotor. The ability of the turbine to vary the momentum of the flowing exhaust gases through the curved section by means of the control valve improves the efficiency of the turbine for a predetermined torque curve throughout a desired engine operating range.

The general object of this invention is to provide an improved variable flow turbine which can be used in a turbocharger to increase the power output of an internal combustion engine. A more specific object of this invention is to provide an improved variable flow turbine which can adjustably increase the velocity of an incoming fluid flow to increase the power output of the turbine.

Another object of this invention is to provide an improved variable flow turbine for a turbocharger which utilizes a control valve upstream of a curved section which is rotatable such that incoming exhaust gas is efficiently directed onto the periphery of the turbine rotor.

Still another object of this invention is to provide an improved variable flow turbine which permits the use of a more efficient compressor at rated engine speed to increase engine efficiency.

A further object of this invention is to provide an improved variable flow turbine which enables an engine to produce a higher low speed torque.

Still further, an object of this invention is to provide an improved variable flow turbine which will produce higher engine efficiency at all engine speeds and loads.

Still further, an object of this invention is to provide an improved variable flow turbine which will improve the transient response of an engine.

Other objects and advantages of the present invention will become more apparent to those skilled in the art in view of the following description and the accompanying drawings.

DETAILED DESCRIPTION OF THE PREFERRED EMBODIMENTS

Figure 1:
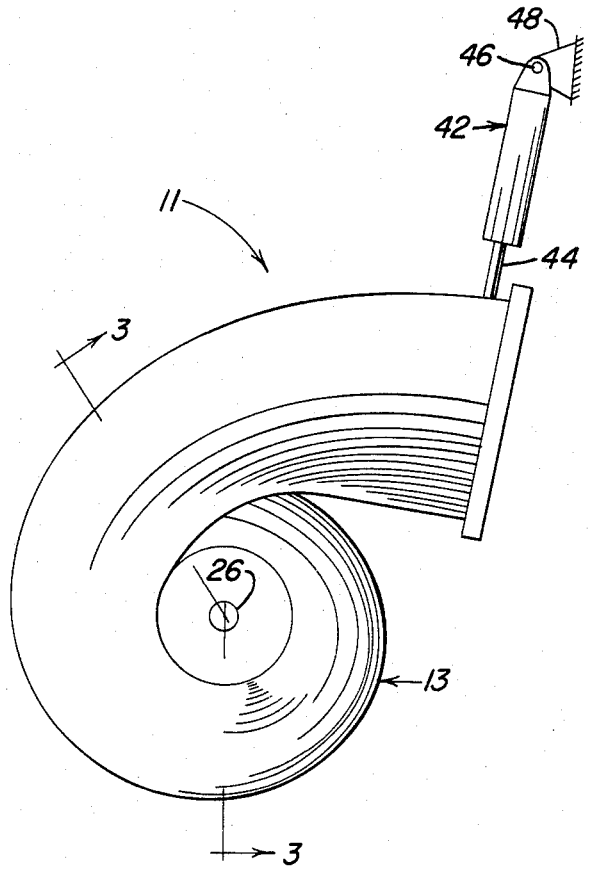
FIG. 1 is a side view of an improved variable flow turbine.
Figure 2:
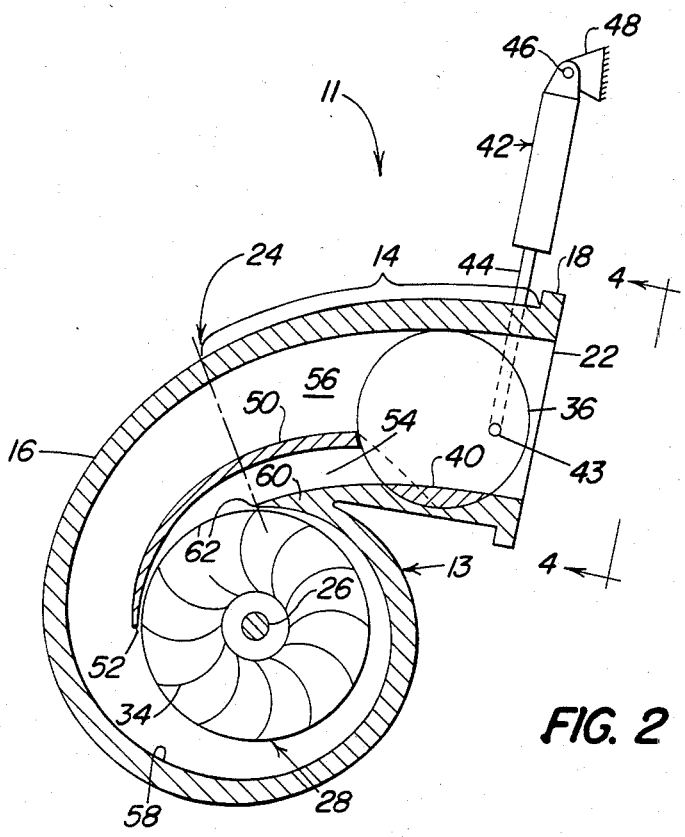
FIG. 2 is a cross-sectional view of FIG. 1 showing the improved variable flow turbine.
Figure 3:
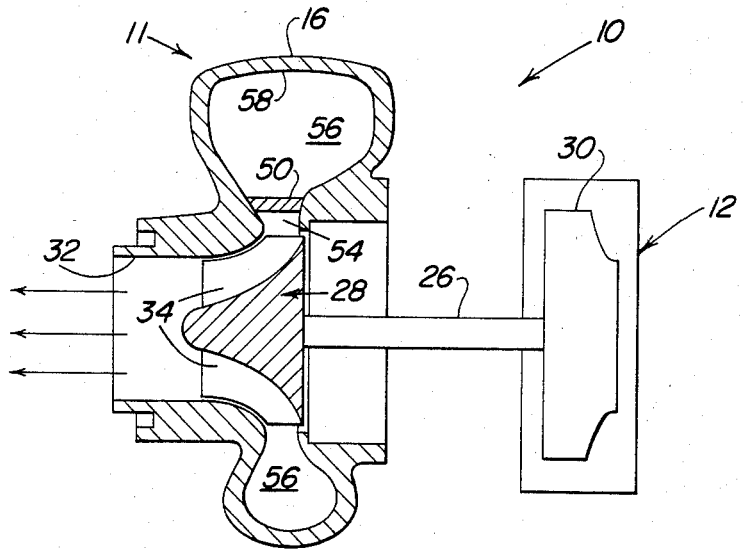
FIG. 3 is a partial sectional view taken along the line 3—3 of FIG. 1 including an attached connecting shaft and compressor.
Figure 4:
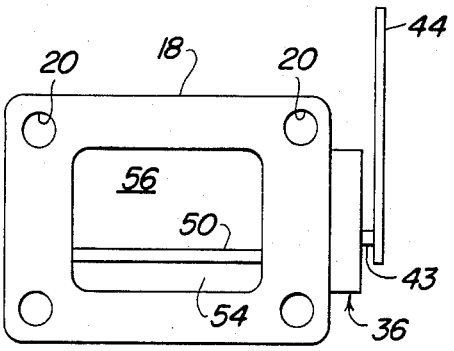
FIG. 4 is a view of the fluid inlet into the variable flow turbine taken along the line 4—4 of FIG. 2.

Referring now to the drawings, particularly FIG. 3, a turbocharger 10 is shown having an improved variable flow turbine 11. The turbine 11, which is connected to a compressor 12, has a housing 13, see FIGS. 1 and 2, constructed of a curved section 14 and a volute section 16. The curved section 14 is an arcuately-shaped member which is adapted to be attached at a first flanged end 18 by bolts (not shown) inserted through bolt holes 20, see FIG. 4, to the exhaust manifold of an internal combustion engine. The curved section 14 has an angular span of at least 30 degrees, preferably 30 to 180 degrees and more preferably about 45 to 90 degrees. The curved section 14 has an inlet 22 formed at the flanged end 18 and joins the volute section 16 at an opposite end 24. The volute section 16 has an angular span of at least 270 degrees and preferably about 360 degrees. The arc for the volute section 16 is formed about an axis which extends perpendicular into the paper as viewed in FIG. 1. A connecting shaft 26 rotatably joins the turbine 11 to the compressor 12 and rotates about the axis of the volute section. The connecting shaft 26 carries a turbine rotor 28 and a compressor wheel 30 at its opposite ends. The turbine rotor 28, which is enclosed in the turbine housing 13, has a plurality of circumferentially spaced blades 34 which extend outward from the central axis in a radial fashion. The particular shape and configuration of the blades 34 can vary as is well known to those skilled in the turbine art. The turbine housing 13 also has an outlet 32 as shown in FIG. 3. As the exhaust gases of an engine are directed into the turbine 11, they cause the turbine rotor 28 to rotate. As the turbine rotor 28 revolves, it causes the compressor wheel 30 to do likewise via the connecting shaft 26. The compressor wheel 30 in turn supplies relatively high pressure charge air to the engine.

Positioned close to the fluid inlet 22 is a control valve 36 for controlling gas flow into the turbine housing 13. The control valve 36, preferably a rotary valve, is fitted to the inner surface of the curved section 14. The control valve 36 has a valve insert 40 which is movable between open and closed positions to regulate gas flow through the variable flow turbine 11. In the open position, see FIG. 2, the valve insert 40 is arranged flush with the inner surface of the curved section 14 and permits the exhaust gases to flow through the entire curved section 14. In the closed position, indicated by the dotted line in FIG. 2, the valve insert 40 restricts the flow path of the gases through the curved section 14. The control valve 36 is operated by a control mechanism 42 via pin 43 and linkage 44. The control mechanism 42 can be pivotally attached at one end 46 to a fixed support 48 so that linear movement of the linkage 44 will cause rotational movement of the control valve 36. It should be noted that the control mechanism 42 can be manually or automatically operated as is well known to those skilled in the art. The control mechanism 42 can also be adapted for substantially any linear or non-linear response to variations of engine parameters, such as: engine operating speed, engine load, intake manifold pressure, engine emissions, smoke density of the exhaust gas leaving the engine and entering the atmosphere, temperature of the exhaust gas, or a combination thereof. In addition, the control mechanism 42 can be adapted to parameters, such as the speed of the turbine rotor 28 and throttle position.

Extending inwardly from the control valve 36 into both sections of the turbine housing 13 is a divider wall 50. The divider wall 50 tapers to a tip 52 which is located approximately tangential to the outer circumference of the turbine rotor 28. This divider wall 50 is an arcuately-shaped member which is integral with the turbine housing 13 and serves to divide the turbine housing 13 into an inner or secondary fluid passage 54 and an outer or primary fluid passage 56. Preferably, the area of the outer fluid passage 56 is larger than the area of the inner fluid passage 54 and more preferably, the area of the outer fluid passage 56 is approximately three times the area of the inner fluid passage 54. When the area of the inner and outer fluid passages 54 and 56 are approximately in a 1 to 3 size relationship, respectively, the outer fluid passage 56 will intersect approximately three times as much of the periphery of the turbine rotor 28 as the inner fluid passage 54. In addition to the size difference of the fluid passages 54 and 56, the divider wall 50 cooperates with an inner surface 58 of the volute section 16, see FIG. 2, to provide a decreasing cross-sectional area of the outer fluid passage 56. Preferably, the cross-sectional area of both of the fluid passages 54 and 56 throughout the curved and the volute sections 14 and 16, respectively, will be constantly decreasing. This feature provides a relatively uniform velocity of the exhaust gases onto the turbine blades 34. Rotation of the control valve 36 from the open position to a partially closed position, directs the exhaust gases outward towards the divider wall 50 and thereby increases the velocity of the exhaust gases flowing in both the inner and outer passages 54 and 56, respectively. This increased velocity combined with the increased mass average radius of curvature of the flowing exhaust gases will increase the power output of the turbine 11.

Further rotation of the control valve 36 to the fully closed position, indicated by the dotted line in FIG. 2, directs all of the flowing exhaust gases through the outer passage 56. This further increases both the velocity and the mass average radius of curvature of the flowing exhaust gases and maximizes the power output of the turbine 11.

The curved section 14 combines with an inner surface 58 of the volute section 16 to form a tongue 60 having a tip 62. The tip 62 is located at the opposite end 24 of the curved section 14 and is in close proximity to the circumference of the turbine rotor 28, approximately tangential to the outer periphery of the turbine rotor 28. The tongue tip 62 is located at an angular span of about 90 degrees from the tip 52 of the divider wall 50 so as to expose about 75 percent of the peripheral area of the turbine rotor 28 to the outer fluid passage 56. The tip 62 and the inner surface 58 control the exhaust gases flowing between the outer periphery of the turbine rotor 28 and the tongue 60. The tip 62 also controls clockwise flow of the exhaust gases which could cause a pulsating effect to be imparted to the turbine rotor 28.

Figure 5:
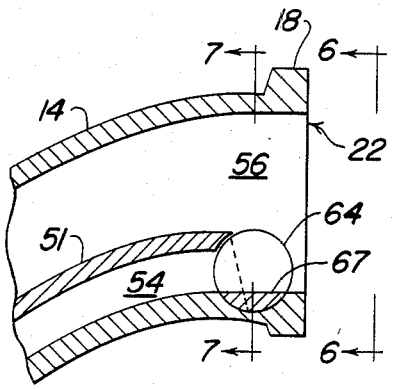
FIG. 5 is an alternate embodiment of a fluid inlet to a turbine having a control valve positioned across the inner passage.
Figure 6:
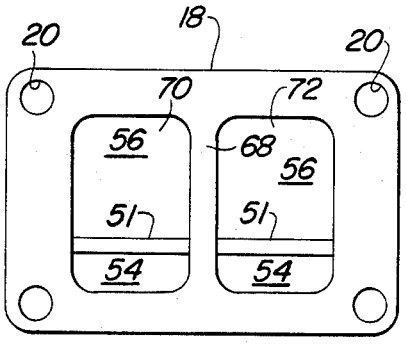
FIG. 6 is a view taken along the line 6—6 of FIG. 5 showing an axially divided turbine housing.
Figure 7:
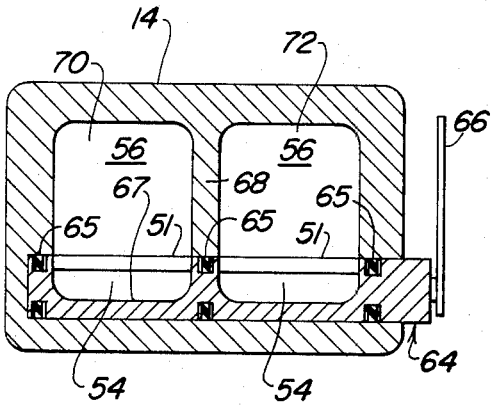
FIG. 7 is a sectional view taken along the line 7—7 of FIG. 5 showing a rotary control valve.

Turning now to FIGS. 5–7, an alternative embodiment for a variable flow turbine is shown having a control valve 64 positioned across the inner fluid passage 54. The control valve 64, having a valve insert 67, is rotatable within the curved section 14 on seals 65, by a control linkage 66, see FIG. 7. As the control valve 64 rotates, the valve insert 67 is movable between open and closed positions. In the open position, as shown in FIG. 5, the valve insert 67 is arranged flush with an inner surface of the curved section 14 and permits the exhaust gases to flow through both the inner and outer fluid passages 54 and 56. By rotating the valve insert 67 toward a divider wall 51 to a partially closed position, a portion of the inner passage 54 is blocked. In the fully closed position, indicated by the dotted line in FIG. 5, the valve insert 67 blocks the exhaust gases from flowing through the inner fluid passage 54. This permits both an increase in the gas velocity and an increase in the mass average radius of curvature of the flowing exhaust gases, thereby increasing the power output of the turbine 11. The alternative embodiment also shows an axial divider wall 68, see FIGS. 6 and 7, which is aligned approximately perpendicular to the divider wall 51 and extends inward from the fluid inlet 22 into both sections 14 and 16 of the turbine housing 13. The axial divider wall 68 divides the turbine housing 13 into a pair of axially separated fluid flow paths 70 and 72, each of which contains inner and outer fluid passages 54 and 56, respectively. Each of the flow paths 70 and 72 is aligned with a separate exhaust manifold pipe to prevent mixing of pulsating exhaust gases prior to their impingement onto the turbine blades 34.

OPERATION

The improved variable flow turbine 11 operates on the exhaust gases from the engine's manifold which pass through the flow passages 54 and 56 and impinge upon the blades 34 of the turbine rotor 28. The turbine rotor 28 will be driven at a rate of speed which is related to the velocity and mass flow of the exhaust gases. Accordingly, the rotational speed of the turbine rotor 28 is related to the engine operating conditions, such as engine speed and load. Furthermore, the cross-sectional flow area and shape of the flow passages 54 and 56, as well as the shape of the divider wall 50, affects the velocity of the exhaust gases and thereby also affects the rotational speed of the turbine rotor 28. By sizing the cross-sectional flow area of the outer passage 56 to be approximately three times the cross-sectional flow area of the inner passage 54 and by utilizing the curved section 14 in front of the volute section 16, one can better control the velocity of the exhaust gases.

By closing the control valve 36. A high velocity gas flow through the outer passage 56 can be obtained at relatively low engine operating speeds. With the inner fluid passage 54 blocked, the entire gas flow must pass through the outer fluid passage 56. This assures that there is sufficient gas velocity to drive the turbine rotor 28 at a sufficient speed to cause the compressor wheel 30 to increase the boost pressure to the engine.

As the speed or load of the engine increases, the velocity and mass flow of the exhaust gases will also increase. At some upper point on the engine's torque curve, the velocity and mass flow of the exhaust gases will turn the turbine rotor 28 so fast that either a component of the turbocharger 10 could exceed critical operational limits and fail or the turbocharger could produce boost pressures that exceed engine operational limits. Before either of these can occur, the control valve 36 is rotated towards the open position to permit the incoming exhaust gases to flow through both the inner and outer flow passages 54 and 56, respectively.

By partially closing the control valve 36, the gas flow is moved further away from the central axis of the turbine rotor 28, thereby increasing the mass average radius of curvature. The velocity is also increased due to the decrease in the cross-sectional area of the curved section 14. For each position of the control valve 36, the gas velocity flowing perpendicular to the radius of curvature immediately downstream of the control valve 36 yields a certain angular momentum. By closing the control valve 36, the mass average radius of curvature and velocity of the flowing exhaust are increased and therefore the angular momentum is increased. This increase in mass average velocity is noticed downstream, at the periphery of the turbine rotor 28, approximately in accordance with the formula:

$$c = \frac{K}{R}$$

where:

c is the mass average velocity of the exhaust gases;

K is a constant value determined by the values of c and R immediately downstream of the control valve, which will produce the desired value of c at the periphery of the turbine rotor; and R is the mass average radius of curvature for the flowing exhaust gases.

The above formula applies to all turbines having volute sections wherein friction and compressibility are neglected.

By partially or fully closing the control valve 36, the velocity of the exhaust gases impinging on the blades 34 of the turbine rotor 28 is increased, which in turn increases the energy transferred to the turbine rotor 28 in accordance with the well known Euler turbine equation:

$$H = \frac{U_1 C_{u1} - U_2 C_{u2}}{g_c}$$

where:

H is the energy transferred to the turbine rotor per unit mass of exhaust gas;

$U_1$ is the velocity of the turbine blades 34 at the periphery of the turbine rotor 28;

$C_{u1}$ is the velocity of the exhaust gas tangential to the periphery of the turbine rotor 28;

$C_{u2}$ is the mass average, tangential velocity of the exhaust gas leaving the turbine rotor 28;

$U_2$ is the velocity of the turbine blade 34 at the mass average radius of the flowing exhaust gas leaving the turbine rotor 28; and $g_c$ is a gravitational constant.

Partially or fully closing the control valve 36 to increase turbocharger speed increases the charge air flow to the engine. This allows more fuel to be injected into the engine for higher engine torque and improved transient response, without exceeding exhaust gas smoke density limits. For engine loads below the maximum torque curve, the control valve 36 can be modulated to provide the optimum combination of air-fuel ratio and pressure differential across the engine for maximum engine efficiency. Likewise, by partially or fully opening the control valve 36 at high engine speeds and loads, the cross-sectional flow area is increased and the mass average, radius of curvature is decreased to control the turbocharger speed and the boost pressure to the engine.

It should be noted that the vaneless nozzle turbine of this invention can handle flowing exhaust gases with velocities above Mach I without encountering choking problems. This ability to handle absolute velocities, which exceed supersonic velocities, is not present in turbines using vane nozzles.

While the invention has been described in conjunction with two specific embodiments, it is to be understood that many alternatives, modifications, and variations will be apparent to those skilled in the art in light of the aforegoing description. Accordingly, this invention is intended to embrace all such alternatives, modifications, and variations which fall within the spirit and scope of the appended claims.

I claim:

1. An improved variable flow turbine for enabling a turbocharger to operate more efficiently, said improvement comprising:

(a) a housing including a curved section with an inlet at one end and joined at a second end to a volute section which is formed about an axis, said volute section having an outlet coaxially aligned with the axis, said curved section further having a direction of curvature in the same direction as said volute section;

(b) a rotor positioned within said housing for rotation about the axis of said volute section, said rotor having a plurality of circumferentially spaced blades;

(c) a valve positioned at said inlet to said curved section for controlling flow therethrough such that as said valve is moved towards a closed position, both the mass average radius of curvature and the velocity of the incoming exhaust gas are increased; and (d) a divider wall formed in said housing and extending from said valve inwardly through said curved section and into said volute section for dividing said housing into inner and outer radial passages, each passage having a cross-sectional area within said volute section which is constantly decreasing as said passage approaches said rotor.

2. The improved variable flow turbine of claim 1 wherein said curved section has an arcuate span of between 30 and 180 degrees.

3. The improved variable flow turbine of claim 2 wherein said curved section has an arcuate span of about 45 to 90 degrees.

4. An improved variable flow turbine for enabling a turbocharger to operate more efficiently over an engine's operating range, said improvement comprising:

(a) a housing including a curved section with an arcuate span of at least 30 degrees and an inlet at one end thereof, said curved section joined at a second end to a volute section having an arcuate span of at least 270 degrees, said volute section formed about an axis and having an outlet coaxially aligned with the axis, an inner surface of said curved section converging with an inner surface of said volute section to form a tongue terminating at the entrance to said volute section, and said curved section further having a direction of curvature in the same direction as said volute section;

(b) a rotor positioned within said housing for rotation about the axis of said volute section and having a plurality of circumferentially spaced blades, the outer periphery of said rotor being aligned approximately tangential to said tongue;

(c) a valve positioned at said inlet of said curved section for controlling flow therethrough such that as said valve is moved towards a closed position, both the mass average radius of curvature and the velocity of the incoming exhaust gas are increased;

(d) a divider wall formed in said housing and extending from said valve to a point located approximately tangential to the circumference of said rotor, said point positioned approximately 90 degrees in arcuate span from the termination of said tongue, said divider wall dividing said housing into inner and outer radial passages, each passage having a cross-sectional area within said volute section which is constantly decreasing as said passage approaches said rotor.

5. The improved variable flow turbine of claim 4 wherein the flow area of said outer passage is larger than the flow area of said inner passage.

6. The improved variable flow turbine of claim 5 wherein the flow area of said outer passage is approximately three times the flow area of said inner passage.

7. The improved variable flow turbine of claim 6 wherein said outer passage intersects approximately three times as much of the periphery of said rotor as said inner passage.

8. The improved variable flow turbine of claim 4 wherein said valve is operative anywhere between a first position wherein said inner passage is fully open to fluid flow and a second position wherein said inner passage is closed to fluid flow.

9. The improved variable flow turbine of claim 8 wherein said valve is rotatable to direct exhaust gases flowing through said inner passage toward said divider wall.

10. The improved variable flow turbine of claim 4 wherein an axial divider is aligned approximately perpendicular to said divider wall and extends axially into said housing from said inlet for dividing said housing into a pair of axially separated flow paths, each having inner and outer fluid passages.

11. An improved variable flow turbine comprising:

(a) a housing including a curved section with an arcuate span of at least 30 degrees and with an inlet at one end thereof, said curved section joined at a second end to a volute section having an arcuate span of at least 270 degrees, said volute section formed about an axis and having an outlet coaxially aligned with the axis, an inner surface of said curved section converging with an inner surface of said volute section to form a tongue terminating at the entrance of said volute section and said curved section further having a direction of curvature in the same direction as said volute section;

(b) a rotor positioned within said housing for rotation about the axis of said volute section and having a plurality of circumferentially spaced blades, the outer periphery of said rotor being aligned approximately tangential to said tongue;

(c) an axial divider extending into said housing from said inlet for dividing said housing into a pair of axially separated flow paths;

(d) a divider wall formed in said housing and extending from said inlet of said curved section to a point located approximately tangential to the circumference of said rotor, said point positioned approximately 90 degrees in arcuate span from the termination point of said tongue, said divider wall dividing each of said flow paths into inner and outer radial passages, each passage having a cross-sectional area within said volute section which is constantly decreasing as said passage approaches said rotor;

(e) a rotary valve positioned at said inlet to said curved section and upstream from said termination point of said tongue for controlling the flow of a gas through said inlet, said rotary valve being operative anywhere between a first position wherein said inner passages are open to gas flow and a second position wherein said inner passages are closed to gas flow, and wherein the closing of said rotary valve increases both the mass average radius of curvature and the velocity of the incoming gas; and (f) means for regulating said rotary valve to move between said first and second positions.

12. The improved variable flow turbine of claim 11 wherein said rotary valve is rotatable to direct exhaust gases flowing through said inner passage toward said divider wall.

13. The improved variable flow turbine of claim 11 wherein said passages in said curved section have a constantly decreasing cross-sectional area from said inlet to said volute section.

14. The improved variable flow turbine of claim 11 wherein said inner and outer radial passages in said curved section have a decreasing radius of curvature as they extend inward from said inlet to said volute section.

15. An improved variable flow turbine comprising:

(a) a housing including a curved section with an inlet at one end and joined at a second end to a volute section which is formed about an axis, said volute section having an outlet coaxially aligned with the axis, and said curved section being curved in the direction of said volute;

(b) a rotor positioned within said housing for rotation about the axis of said volute section, said rotor having a plurality of circumferentially spaced blades;

(c) a valve positioned at said inlet and within said curved section for controlling flow therethrough such that as said valve is moved towards a closed position, both the mass average radius of curvature and the velocity of the incoming exhaust gas are increased; and (d) a divider wall formed in said housing and extending from said valve inwardly through said curved section and into said volute section for dividing said housing into inner and outer radial passages, each passage having a cross-sectional area within said volute section which is constantly decreasing as said passage approaches said rotor.

16. An improved variable flow turbine comprising:

(a) a housing including a curved section with an inlet at one end and joined at a second end to a volute section which is formed about an axis, said volute section having an outlet coaxially aligned with the axis, and said curved section being curved in the direction of said volute;

(b) a rotor positioned within said housing for rotation about the axis of said volute section, said rotor having a plurality of circumferentially spaced blades;

(c) a divider wall formed within both said curved section and said volute section for dividing said housing into inner and outer radial passages, each passage having a cross-sectional area within said volute section which is constantly decreasing as said passage approaches said rotor; and (d) a rotary valve positioned within said curved section between said inlet and said divider wall, said rotary valve being operative between a first position wherein said inner passage is open to gas flow and a second position wherein said inner passage is closed to gas flow, and wherein the closing of said rotary valve increases both the mass average radius of curvature and the velocity of the incoming gas.

17. An improved variable flow turbine for enabling a turbocharger to operate more efficiently, said improvement comprising:

(a) a housing including a curved section with an inlet at one end and joined at a second end to a volute section which is formed about an axis, said volute section having an outlet coaxially aligned with the axis, said curved section further having a direction of curvature in the same direction as said volute section;

(b) a rotor positioned within said housing for rotation about the axis of said volute section, said rotor having a plurality of circumferentially spaced blades;

(c) a divider wall formed in said housing and extending from a point adjacent to said inlet to said curved section to a point located approximately tangential to the circumference of said rotor, said divider wall dividing said housing into inner and outer radial passages, each passage having a cross-sectional area within said volute section which is constantly decreasing as said passage approaches said rotor; and (d) a valve positioned at said inlet to said curved section for controlling flow through said inner radial passage such that as said valve is moved towards a closed position, both the mass average radius of curvature and the velocity of the incoming exhaust gas are increased.

18. An improved variable flow turbine for enabling a turbocharger to operate more efficiently over an engine's operating range, said improvement comprising:

(a) a housing including a curved section with an arcuate span of at least 30 degrees and an inlet at one end thereof, said curved section joined at a second end to a volute section having an arcuate span of at least 270 degrees, said volute section formed about an axis and having an outlet coaxially aligned with the axis, an inner surface of said curved section converging with an inner surface of said volute section to form a tongue terminating at the entrance to said volute section, and said curved section further having a direction of curvature in the same direction as said volute section;

(b) a rotor positioned within said housing for rotation about the axis of said volute section and having a plurality of circumferentially spaced blades, the outer periphery of said rotor being aligned approximately tangential to said tongue;

(c) a divider wall formed in said housing and extending from a point adjacent to said inlet to said curved section to a point located approximately tangential to the circumference of said rotor, said point positioned approximately 90 degrees in arcuate span from the termination of said tongue, said divider wall dividing said housing into inner and outer radial passages, each passage having a cross-sectional area within said volute section which is constantly decreasing as said passage approaches said rotor; and (d) a rotary valve positioned at said inlet to said curved section for controlling flow through said inner radial passage, said rotary valve capable of rotating outward away from an inner surface of said curved section such that as said valve is moved towards a closed position, both the mass average radius of curvature and the velocity of the incoming exhaust gas are increased through said outer radial passage.

19. An improved variable flow turbine comprising:

(a) a housing including a curved section with an arcuate span of at least 30 degrees and with an inlet at one end thereof, said curved section joined at a second end to a volute section having an arcuate span of at least 270 degrees, said volute section formed about an axis and having an outlet coaxially aligned with the axis, an inner surface of said curved section converging with an inner surface of said volute section to form a tongue terminating at the entrance of said volute section and said curved section further having a direction of curvature in the same direction as said volute section;

(b) a rotor positioned within said housing for rotation about the axis of said volute section and having a plurality of circumferentially spaced blades, the outer periphery of said rotor being aligned approximately tangential to said tongue;

(c) an axial divider formed in said housing and extending inward from said inlet of said curved section for dividing said housing into a pair of axially separated flow paths;

(d) a divider wall formed in said housing and extending from a point adjacent to said inlet to said curved section to a point located approximately tangential to the circumference of said rotor, said point positioned approximately 90 degrees in arcuate span from the termination point of said tongue, said divider wall dividing each of said flow paths into inner and outer radial passages, each passage having a cross-sectional area within said volute section which is constantly decreasing as said passage approaches said rotor;

(e) a rotary valve positioned at said inlet to said curved section and upstream from said termination point of said tongue for controlling the flow of a gas through said inlet, said rotary valve being operable anywhere between a first position wherein said inner passages are open to gas flow and a second position wherein said inner passages are closed to gas flow, and wherein the closing of said rotary valve increases both the mass average radius of curvature and the velocity of the incoming gas; and (f) means for regulating said rotary valve to move between said first and second positions.

* * * * *